US006203224B1

(12) United States Patent
Kerr

(10) Patent No.: US 6,203,224 B1
(45) Date of Patent: Mar. 20, 2001

(54) PRINT ENGINE CHASSIS FOR SUPPORTING A VACUUM IMAGING DRUM

(75) Inventor: Roger S. Kerr, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/493,920

(22) Filed: Jan. 28, 2000

(51) Int. Cl.[7] ..... B41J 29/02
(52) U.S. Cl. ..... 400/694; 400/691
(58) Field of Search ..... 400/694, 693, 400/691, 690, 689

(56) References Cited

U.S. PATENT DOCUMENTS 1,614,604 * 1/1927 Dobson ..... 400/690
2,670,834 * 3/1954 Schroder ..... 400/690
4,616,944 * 10/1986 Galatha et al. ..... 400/691
4,723,857 * 2/1988 Yokoi ..... 400/693
5,110,283 5/1992 Bluml et al. ..... 425/589
5,268,708 12/1993 Harshbarger et al. ..... 346/134
5,413,427 * 5/1995 Giles et al. ..... 400/691
5,415,610 5/1995 Schutz et al. ..... 483/16
5,678,291 10/1997 Braun ..... 29/26
5,765,818 6/1998 Sabatino et al. ..... 267/137

* cited by examiner

*Primary Examiner*—John S. Hilten
*Assistant Examiner*—Anthony H. Nguyen
(74) *Attorney, Agent, or Firm*—Nelson Adrian Blish

(57) ABSTRACT

A print engine chassis comprising a sheet metal frame (12) and a filler material (54) of castable polymer. The chassis is fabricated by joining the interlocking rigid members using tabs (36) and slots (38) junctions to form a sheet metal frame (12). A castable polymer substance (54) is then applied to cavities and troughs (58,60) created when these interlocking rigid members are joined. When the polymer concrete hardens, the resulting chassis provides structural support comparable to a casting with improved vibration damping.

5 Claims, 3 Drawing Sheets

PRINT ENGINE CHASSIS FOR SUPPORTING A VACUUM IMAGING DRUM

FIELD OF THE INVENTION

This invention generally relates to a color proofing apparatus and methods of manufacture and more particularly to a print engine chassis fabricated using sheet metal reinforced with castable polymer concrete.

BACKGROUND OF THE INVENTION

Pre-press color proofing is a procedure used by the printing industry for creating representative images of printed material. This procedure avoids the high cost and time required to produce printing plates and also avoids setting-up a high-speed, high-volume printing press to produce a representative sample, as a proof, of an intended image for printing. Otherwise, in the absence of pre-press proofing, a production run may require several corrections and be reproduced several times to satisfy customer requirements. This results in lost time and profits. By utilizing pre-press color proofing, time and money are saved.

A laser thermal printer having half-tone color proofing capabilities is disclosed in commonly assigned U.S. Pat. No. 5,268,708 titled "Laser Thermal Printer With An Automatic Material Supply" issued Dec. 7, 1993 in the name of R. Jack Harshbarger, et al. The Harshbarger, et al. device is capable of forming an image on a sheet of thermal print media by transferring dye from a roll of dye donor material to the thermal print media. This is achieved by applying thermal energy to the dye donor material to form the intended image on the thermal print media. This apparatus generally comprises a material supply assembly; a lathe bed scanning subsystem, which includes a lathe bed scanning frame, a translation drive, a translation stage member, a laser printhead; and a rotatable vacuum imaging drum; and exit sports for exit of thermal print media and dye donor material from the printer.

The operation of the Harshbarger, et al. apparatus comprises metering a length of the thermal print media in roll form from a material supply assembly. The thermal print media is then measured and cut into sheet form of the required length, transported to the vacuum imaging drum, registered, and then wrapped around and secured onto the vacuum imaging drum. Next, a length of dye donor roll material is also metered out of the material supply assembly, measured and cut into sheet form of the required length. The cut sheet of dye donor roll material is then transported to and wrapped around the vacuum imaging drum, such that it is superposed in registration with the thermal print media.

After the dye donor material is secured to the periphery of the vacuum imaging drum, the scanning subsystem and printhead exposes the thermal print media while the vacuum imaging drum rotates past the printhead. The translation drive then traverses the print head and translation stage member axially along the rotating vacuum imaging drum in coordinated motion with the rotating vacuum imaging drum to produce the intended image on the thermal print media.

Although the printer disclosed in the Harshbarger, et al. patent performs well, there is a long-felt need to reduce manufacturing costs for this type of printer and for similar types of imaging apparatus. With respect to the lathe bed scanning frame disclosed in the Harshbarger, et al. patent, the machined casting used as the frame represents significant cost relative to the overall cost of the printer. Cost factors include the design and fabrication of the molds, the casting operation, and subsequent machining needed in order to achieve the precision necessary for a lathe bed scanning engine used in a printer of this type.

Castings present inherent problems in modeling, making it difficult to use tools such as finite element analysis to predict the suitability of a design. Moreover, due to shrinkage, porosity, and other manufacturing anomalies, it is difficult to obtain uniform results when casting multiple frames. In the assembly operation, each frame casting must be individually assessed for its suitability to manufacturing standards and must be individually machined. Further, castings also exhibit frequency response behavior, such as to resonant frequencies, which are difficult to analyze or predict. For this reason, the task of identifying and reducing vibration effects can require considerable work and experimentation. Additionally, the overall amount of time required between completion of a design and delivery of a prototype casting can be several weeks or months.

The combined weight of the imaging drum, motor and encoder components, and print head translation assembly components, plus the inertial forces applied when starting and stopping the drum require a frame having substantial structural strength. For this reason, a sheet metal frame, by itself, would not provide a solution. Alternative methods used for frame fabrication have been tried, with some success. For example, welded frame structures have been used. However, these welded structures require significant expense in manufacture and do not provide the structural stability available from castings.

Alternatives to metal castings have been used by manufacturers of machine tools. In particular, castable polymers, manufactured under a number of trade names, have been employed to provide support structures that are at least equivalent to castings for apparatus such as machine tool beds and optical tables. These castable polymers also provide improved performance when compared with castings, with respect to expansion and contraction due to heat and with respect to vibration damping.

Castable polymers have been employed to provide substitute structures for metal castings and weldments. One example is disclosed in U.S. Pat. No. 5,415,610 (Schutz et al.) which discloses a frame for machine tools using castable concrete to form a single casting of a bed and a vertical wall for a machine tool. U.S. Pat. Nos. 5,678,291 (Braun) and 5,110,283 (Bluml et al.) are just two of a number of examples in which castable polymer concrete is used as a machine tool bed or for mounting guide rails in machining environments. Castable polymers are also used in the machine tool environment for damping mechanisms, as is disclosed in U.S. Pat. No. 5,765,818 (Sabatino et al.) In these and similar applications, castable polymer concrete is used to provide a substantial mass of material, such as for the bed of a machine tool. These patents do not disclose selective use of castable polymers to supplement a metal structure with additional structural integrity.

There has been a long-felt need to reduce the cost and complexity of printer fabrication without compromising the structural strength required for the lathe bed scanning assembly. However, up to this time, printer solutions have been limited to the use of conventional machined castings or weldments.

SUMMARY OF THE INVENTION

An object of the present invention is to provide a reinforced sheet metal structure for a print engine chassis has high structural rigidity, is economical, and which can be manufactured easily.

According to one aspect of the present invention a print engine chassis supports a vacuum imaging drum and a printhead translation assembly. The chassis comprises a sheet metal frame of interlocking rigid members and a filler material which is poured into the sheet metal frame to provide rigidity at points where the rigid members interlock.

According to one embodiment of the present invention, sheet metal cut to form the interlocking rigid members have an arrangement of tabs and slots that allow the interlocking rigid members to be quickly assembled by hand to form the sheet metal frame of the chassis. A filler material, preferably of castable polymer concrete, is poured into selective cavities formed within the sheet metal frame formed by the rigid members.

An advantage of the present invention is that individual interlocking rigid members can be modified in order to change the design of the chassis, even to modify the size or configuration of the overall structure. This contrasts with methods using a casting, which cannot be easily modified or scaled dimensionally. This scalable feature is particularly beneficial in allowing redesign or in modifying a design to adjust the response to induced vibrational frequencies.

Another advantage of the present invention is that an individual interlocking rigid member can be fabricated to allow its use with a number of different configurations. By providing alternate slot and tab features on the rigid members, a designer may provide for use in a number of different ways when assembled. This results in potential cost savings, cutting down the number of parts that would be needed to support multiple printer configurations.

Yet another advantage of the present invention is that a castable filler can be selected having optimal properties for vibration damping for different printers.

Yet another advantage of the present invention is that parts can be added to a chassis during assembly, at the time the castable polymer filler is applied. This saves cost over machining and allows changes to be easily incorporated into the design.

These and other objects, features and advantages of the present invention will become apparent to those skilled in the art upon a reading of the following detailed description when taken in conjunction with the drawings wherein there is shown and described illustrative embodiments of the invention.

The invention and its objects and advantages will become more apparent in the detailed description of the preferred embodiment presented below.

DETAILED DESCRIPTION OF THE INVENTION

The present description will be directed in particular to elements forming part of, or cooperating more directly with, the apparatus in accordance with the invention. It will be understood that elements not specifically shown or described may take various forms well known to those skilled in the art.

Figure 1:
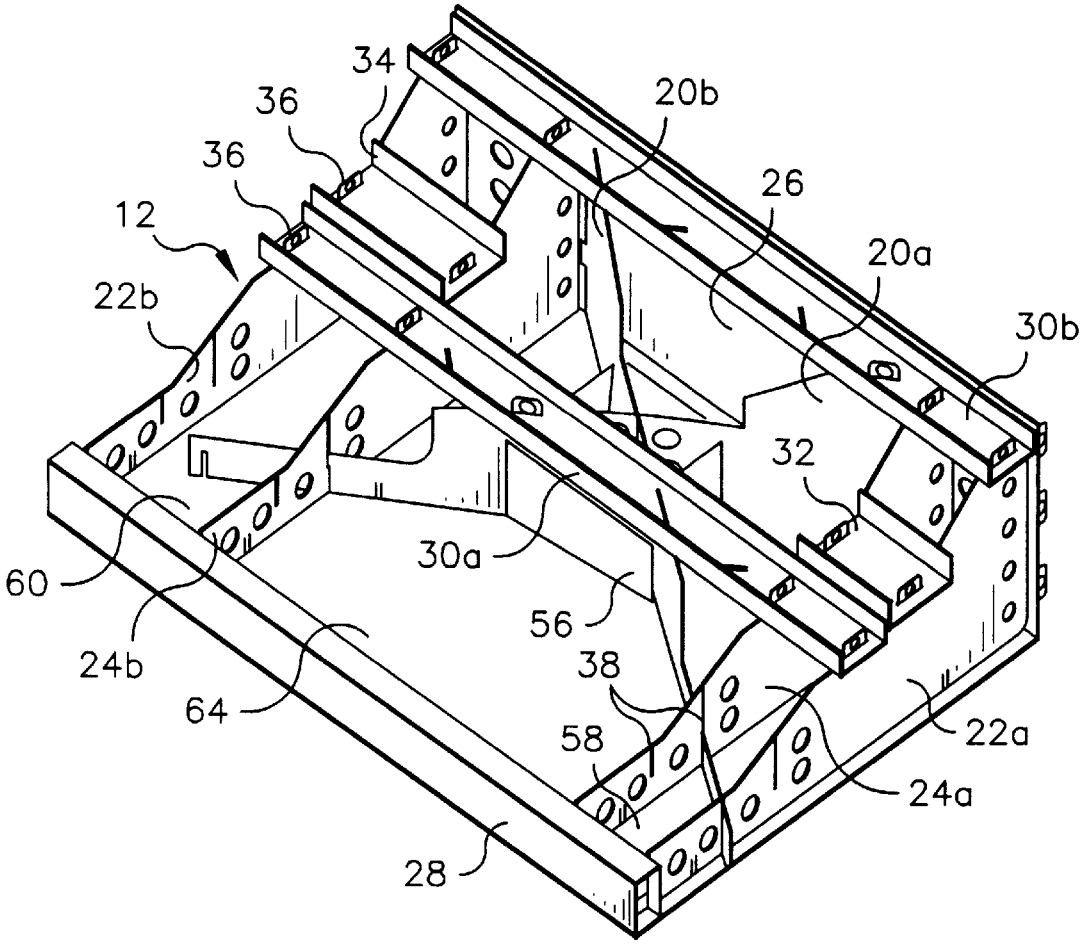
FIG. 1 is a perspective view of a skeletal sheet metal structure according to the preferred embodiment of the invention.

Referring to FIG. 1, there is shown a sheet metal frame 12 that forms a skeleton for the chassis of a print engine. In the preferred embodiment, sheet steel of 0.090 in. thickness (nominal) is used to provide sufficient strength. Sheet steel members may be stamped or cut from stock using laser cutting techniques, well known in the sheet metal art.

Sheet metal frame 12 comprises side walls 22*a* and 22*b*, inner walls 24*a* and 24*b*, a rear wall 26, and a front member 28 mounted on a base 64. Sheet metal frame 12 further comprises supporting and bracing structures provided by full-length cross-struts 30*a* and 30*b* and cross braces 20*a* and 20*b*. A left cross-strut 34 spans between side wall 22*b* and inner wall 24*b*. A right cross-strut 32 spans between side wall 22*a* and inner wall 24*a* These parts, which form the sheet metal frame 12, are collectively referred to as rigid members.

Referring again to FIG. 1, rigid members that form sheet metal frame 12 are joined using slot-to-tab or slot-to-slot construction. At each junction of rigid members, a slot 38 is provided. In this arrangement, slot 38 mates with a corresponding slot 38 on a joining member or slot 38 is fitted to a tab 36. A bracing box 56 having a slot at each vertical corner fits about the junction of cross braces 20*a* and 20*b*. Side wall 22*a* and inner wall 24*a* form a right side cavity 58. Side wall 22*b* and inner wall 24*b* form a left side cavity 60.

Using an arrangement of sheet metal members configured as is shown in FIG. 1, it can be seen that a design can be implemented that allows the same members to be used for different print engine configurations. For example, inner wall 24*a* could be disposed further to the left within sheet metal frame 12. This might be preferable, for example, where the weight of supported motor structures requires additional support. By cutting additional slots into front member 28, cross braces 20*a* and 20*b*, and rear wall 26, inner wall 24*a* could be suitably repositioned in a number of different locations, at different distances from side wall 22*a*. Alternately, the overall dimensions of sheet metal frame 12 could be altered while using many of the same rigid members. For example, the length of a chassis frame could be changed simply by altering the lengths of full-length cross strut 30*a*, front member 28, and rear wall 26.

Figure 2:
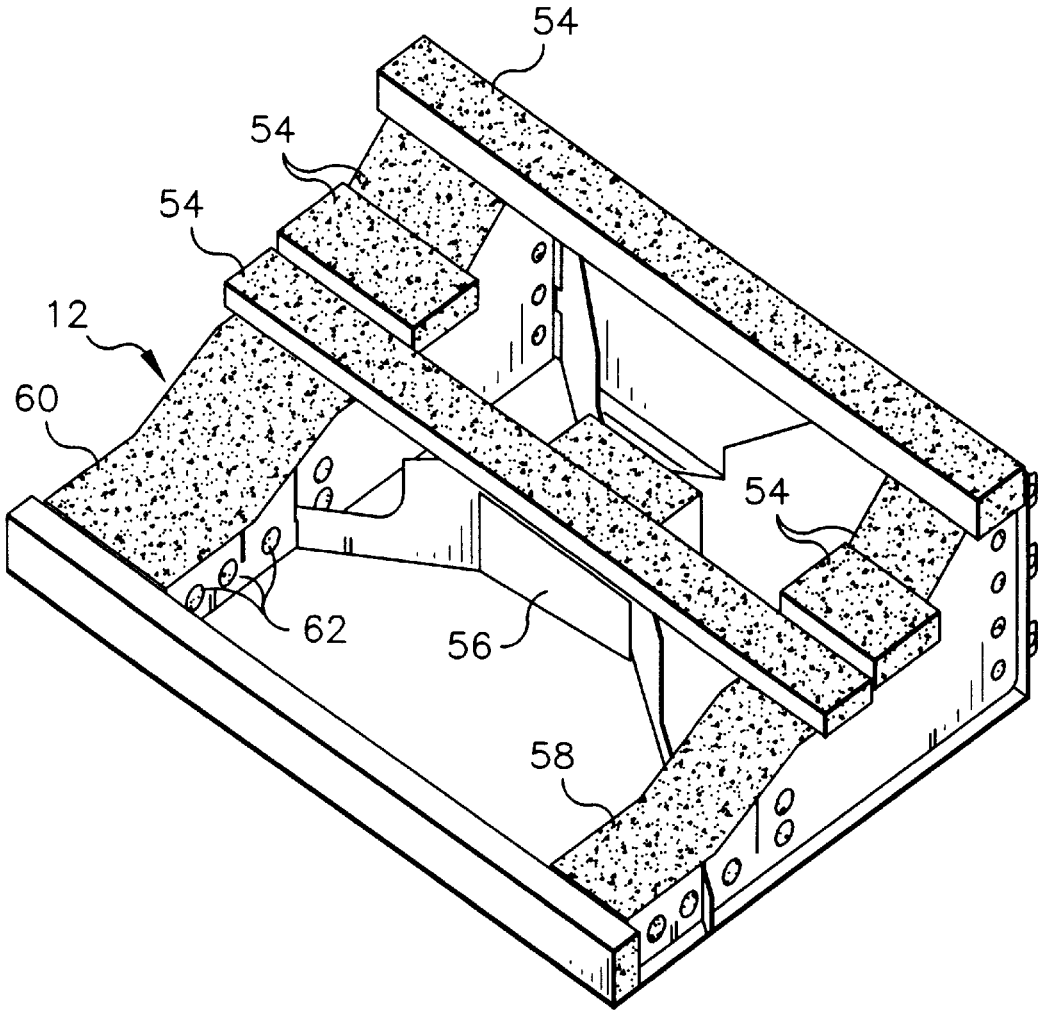
FIG. 2 is a view in perspective of a skeletal sheet metal structure after a filler material has been added.

FIG. 2 shows sheet metal frame 12 reinforced using the method of the present invention. A filler material 54 is poured into left side and right side cavities 60 and 58, into bracing box 56, and into troughs formed by left cross-strut 34, full-length cross-struts 30*a* and 30*b*, and right cross strut 32 within sheet metal frame 12. Filler material 54 is also poured or pumped into front member 28. Filler material 54 hardens and locks sheet metal members of sheet metal frame 12 rigidly into place.

Filler material 54 is preferably a castable polymer concrete, such as "SUPER ALLOY" Polymer Concrete manufactured by Philadelphia Resins, located in Montgomeryville, Pa. Castable polymer substances such as the "SUPER ALLOY" mixture provide a stable structure for the print engine chassis. For print engine applications, castable polymer concrete is particularly well suited, since this substance provides excellent vibration damping. Moreover, since aggregate size can be changed, castable polymer concrete can be modified to optimize vibration response characteristics for specific equipment applications.

The process of pouring the castable polymer requires a minimum of preparation. Holes 62 in sheet metal members are sealed with tape in order to trap the castable polymer within a cavity while the polymer is hardening. Slotted junctions can also be sealed with tape as preparation for pouring. In the preferred embodiment, tabs 36 include holes to allow flow-through of the castable polymer when poured. Upon hardening, the castable polymer fills the hole, further locking tab 36 into place.

Referring again to FIGS. 1 and 2, it is noted that various mounting components can be embedded within the castable polymer concrete. When the castable polymer concrete hardens, embedded components are locked into position. This technique could be used for parts that require precision alignment, effectively using the castable polymer concrete to lock components precisely into place. Tubing could also be inserted within a cavity to allow routing of wires or air flow circulation through the polymer concrete material.

Figure 3:
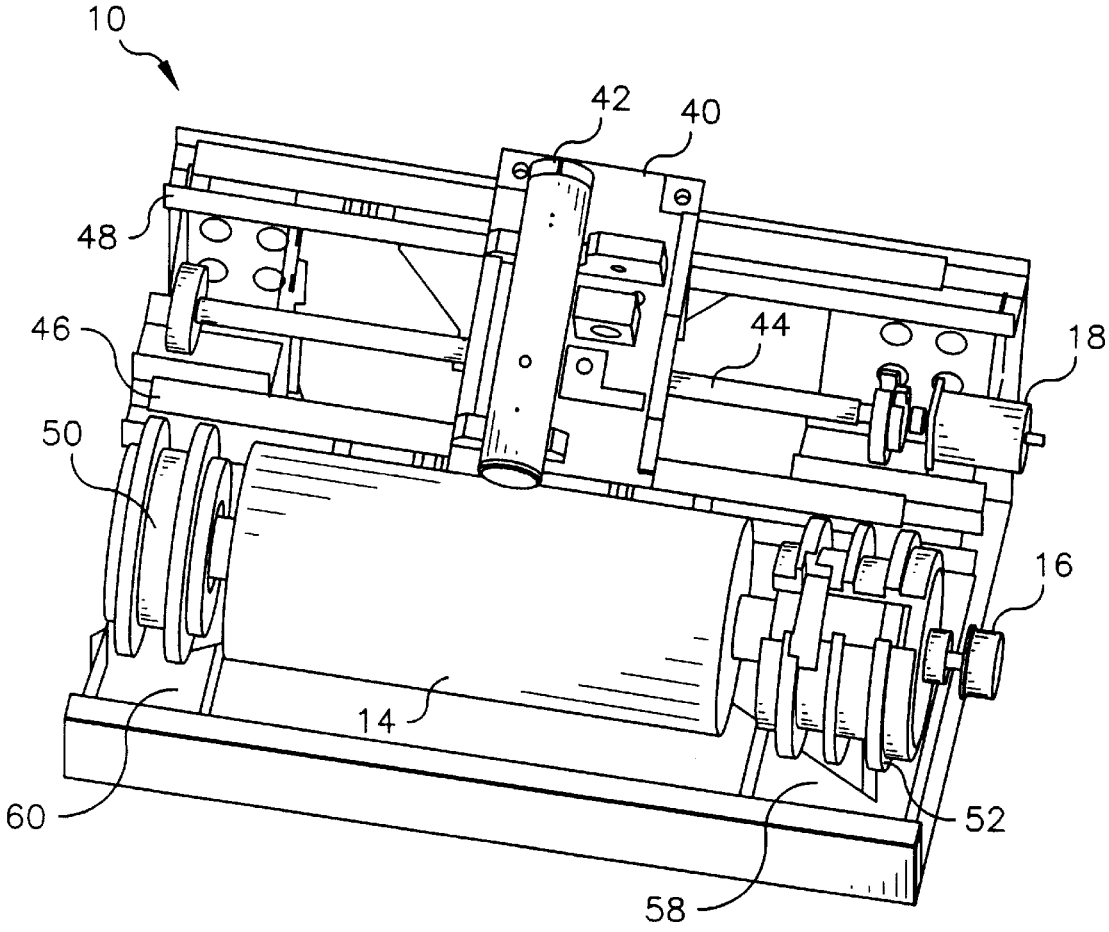
FIG. 3 is a view in perspective of the print engine having an imaging drum, printhead translation assembly, and associated motors.

Referring to FIG. 3, there is shown a print engine 10 having a vacuum imaging drum 14, driven by a drum motor 16. Drum 14 is mounted to rotate within a left hub end 50 and a right hub end 52 that support drum bearings (not shown). Both left hub end 50 and right hub end 52 are held in place by the castable polymer concrete that acts as filler material 54 within right side cavity 58 and left side cavity 60. A translation motor 18 drives a printhead transport 40 containing a printhead 42 by means of a lead screw 44. A front guide rail 46 and a rear guide rail 48 support printhead transport 40 over its course of travel from left to right as viewed in FIG. 3.

Referring again to FIG. 3, it can be seen that the design of sheet metal frame 12, reinforced by filler material 54 as disclosed herein, allows a flexible arrangement of components for print engine 10. For example, relative widths of left side cavity 60 and right side cavity 58 could be reversed to reverse the arrangement of drum motor 16 and hub ends 50 and 52. Print engine 10 could thereby be modified to optimize a writing direction, such as by reversing the path traveled by printhead transport 40.

While the invention has been described with particular reference to its preferred embodiments, it will be understood by those skilled in the art that various changes may be made and equivalents may be substituted for elements of the preferred embodiments without departing from the invention. For example, sheet metal could be replaced at selective locations in the chassis, such as by rigid plastic members. A variety of filler materials could be used, with formulations optimized for the specific application.

The invention has been described in detail with particular reference to certain preferred embodiments thereof, but it will be understood that variations and modifications can be effected within the scope of the invention.

PARTS LIST

10. Print engine
12. Sheet metal frame
14. Imaging drum
16. Drum motor
18. Translation motor
20*a*. Cross-brace
20*b*. Cross-brace
22*a*. Side wall
22*b*. Side wall
24*a*. Inner wall
24*b*. Inner wall
26. Rear wall
28. Front member
30*a*. Full-length cross-strut
30*b*. Full-length cross-strut
32. Right cross-strut
34. Left cross-strut
36. Tab
38. Slot
40. Printhead transport
42. Printhead
44. Lead screw
46. Front guide rail
48. Rear guide rail
50. Left hub-end
52. Right hub-end
54. Filler material
56. Bracing box
58. Right side cavity
60. Left side cavity
62. Holes
64. Base

What is claimed is:

1. A print engine chassis for supporting a vacuum imaging drum and a printhead translation assembly, the chassis comprising:

a sheet metal frame comprising a plurality of interlocking rigid members so joined as to provide cavities and troughs capable of containing a solid material;

a filler material wherein said filter material is poured into cavities and troughs of a skeletal frame formed by said interlocking rigid members to provide rigidity to the print engine chassis wherein said sheet metal frame further comprises cross-brace members, wherein said cross-brace members are held rigidly in place by said filler material poured at the intersection of said cross-brace members.

2. The print engine chassis of claim 1 wherein said filler material is a castable polymer concrete.

3. The print engine chassis of claim 2 wherein said castable polymer concrete provides vibration damping for said print engine chassis.

4. The print engine chassis of claim 1 wherein at least one of said interlocking rigid members comprises a tab having a cavity capable of containing said filler material.

5. The print engine chassis of claim 1 wherein said plurality of interlocking members are coupled using tabs and slots.

* * * * *